US008353675B2

(12) United States Patent
Lin

(10) Patent No.: US 8,353,675 B2
(45) Date of Patent: Jan. 15, 2013

(54) HANGING FRAME ASSEMBLY FOR CEILING FAN

(76) Inventor: Mao-Hsin Lin, Tanzih Township (TW)

( * ) Notice: Subject to any disclaimer, the term of this patent is extended or adjusted under 35 U.S.C. 154(b) by 844 days.

(21) Appl. No.: 12/466,749

(22) Filed: May 15, 2009

(65) Prior Publication Data

US 2010/0221120 A1 Sep. 2, 2010

(30) Foreign Application Priority Data

Mar. 2, 2009 (TW) ..... 98203070 U

(51) Int. Cl.
*F04D 29/18* (2006.01)

(52) U.S. Cl. ..... 416/244 R

(58) Field of Classification Search ..... 248/342, 248/343, 344, 288.31, 323, 324, 610; 416/244 R, 416/500

See application file for complete search history.

(56) References Cited

U.S. PATENT DOCUMENTS

| | | | | |
|---|---|---|---|---|
| 4,697,777 | A * | 10/1987 | Yang | 248/343 |
| 2003/0213883 | A1* | 11/2003 | Fu-Liang | 248/343 |
| 2006/0263224 | A1* | 11/2006 | Wang | 416/244 R |
| 2008/0124224 | A1* | 5/2008 | Tsai | 416/244 R |
| 2008/0181782 | A1* | 7/2008 | Pearce | 416/244 R |
| 2009/0230274 | A1* | 9/2009 | Tang | 248/343 |

* cited by examiner

*Primary Examiner* — Douglas King

(57) ABSTRACT

A hanging frame assembly includes a support seat made of metal and having a bottom wall forming a substantially C-shaped ring, two angularly spaced-apart sidewalls extending upwardly from an outer peripheral end of the bottom wall, two wing plates bending outwardly and respectively from top ends of the sidewalls, and a plurality of angularly spaced-apart positioning ribs extending upwardly from an inner peripheral end of the bottom wall. A buffer piece made of rubber is mounted on the bottom wall, forms a substantially C-shaped ring, and has a plurality of angularly spaced-apart positioning grooves receiving fittingly and respectively the positioning ribs.

3 Claims, 5 Drawing Sheets

HANGING FRAME ASSEMBLY FOR CEILING FAN

CROSS-REFERENCE TO RELATED APPLICATION

This application claims priority of Taiwanese Application No. 098203070, filed on Mar. 2, 2009.

BACKGROUND OF THE INVENTION

1. Field of the Invention

This invention relates to a hanging frame assembly for a ceiling fan.

2. Description of the Related Art

Referring to FIG. 1, a conventional hanging frame assembly for a ceiling fan includes a support seat 6 and a connecting element 7. The support seat 6 includes a bottom wall 61 forming a substantially C-shaped ring, two angularly spaced-apart sidewalls 62 extending upwardly from an outer peripheral end of the bottom wall 61, two wing plates 63 extending outwardly and respectively from top ends of the sidewalls 62, and an annular rib 64 projecting upwardly from an inner peripheral end of the bottom wall 61. Each wing plate 63 has three spaced-apart through holes 65 for extension of a plurality of screws therethrough to fix each wing plate 63 to a ceiling. The connecting element 7 has a substantially C-shaped main body 71 mounted on the bottom wall 61, having an inner peripheral surface 712, and provided with an annular groove 72 receiving the annular rib 64.

In use, a tubular rod (not shown) is supported on the connecting element 7 for hanging the ceiling fan, and the inner peripheral surface 712 supports the ceiling fan. Since the conventional hanging frame assembly is not provided with a buffer piece, when the ceiling fan is rotated, noise is continuously produced, especially when the conventional hanging frame assembly is made of rigid metal. Hence, products now available in the market commonly use soft metals, such as aluminum, for making the connecting element 7. However, the noise produced during rotation of the ceiling fan cannot be completely eliminated. Further, the conventional hanging frame assembly made from aluminum is not strong.

SUMMARY OF THE INVENTION

Therefore, the object of the present invention is to provide a hanging frame assembly for a ceiling fan that is capable of overcoming the aforementioned drawbacks of the prior art.

According to this invention, a hanging frame assembly for a ceiling fan comprises a support seat and a buffer piece. The support seat is made of metal, and includes a bottom wall forming a substantially C-shaped ring, two angularly spaced-apart sidewalls extending upwardly from an outer peripheral end of the bottom wall, two wing plates bending outwardly and respectively from top ends of the sidewalls, and a plurality of angularly spaced-apart positioning ribs extending upwardly from an inner peripheral end of the bottom wall. The buffer piece is mounted on the bottom wall, is made of rubber, forms a substantially C-shaped ring, and has a plurality of angularly spaced-apart positioning grooves receiving fittingly and respectively the positioning ribs.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
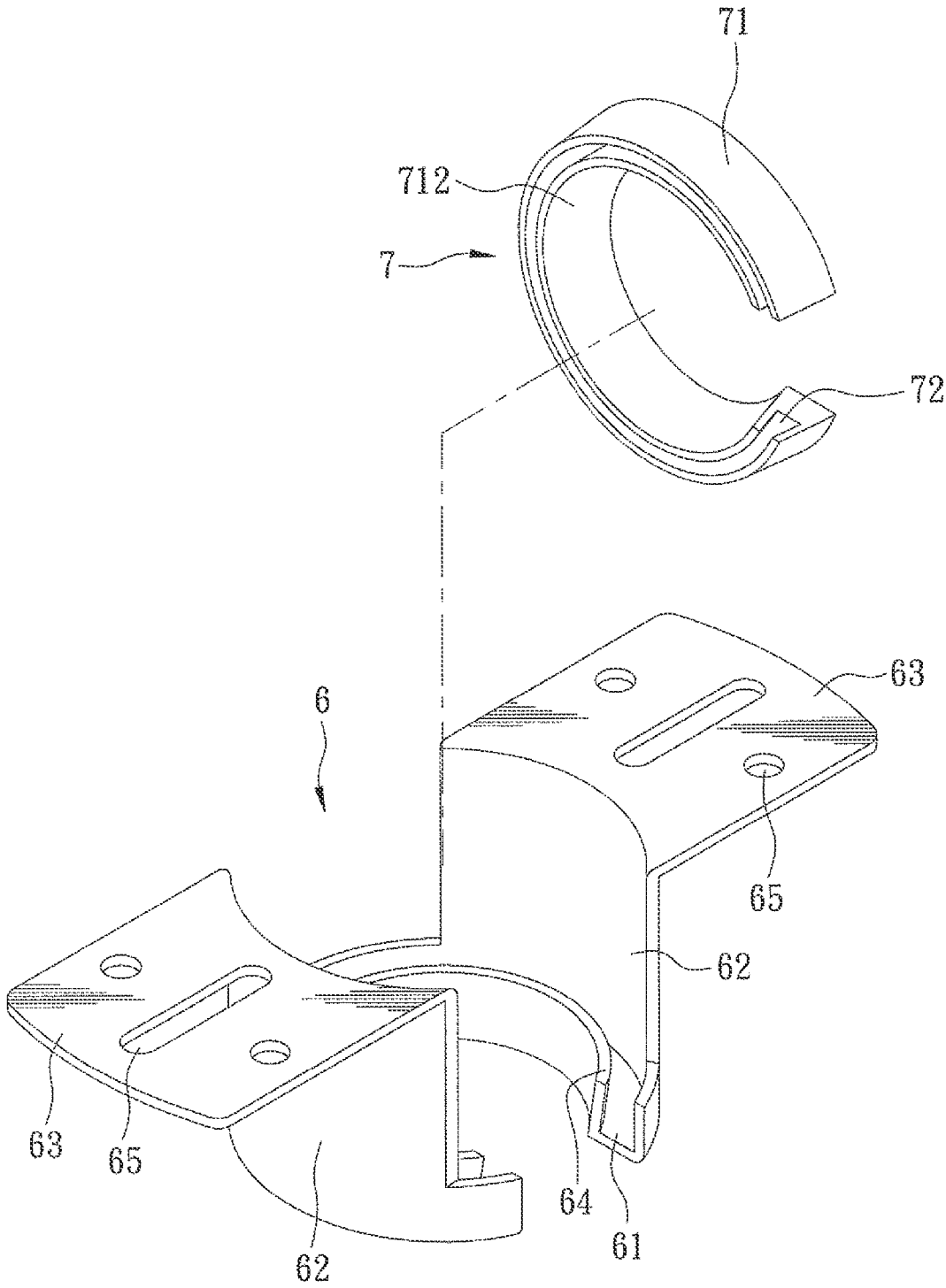
FIG. 1 PRIOR ART
FIG. 1 is an exploded perspective view of a conventional hanging frame assembly for a ceiling fan.

Before the present invention is described in greater detail, it should be noted that the same reference numerals have been used to denote like elements throughout the specification.

Figure 2:
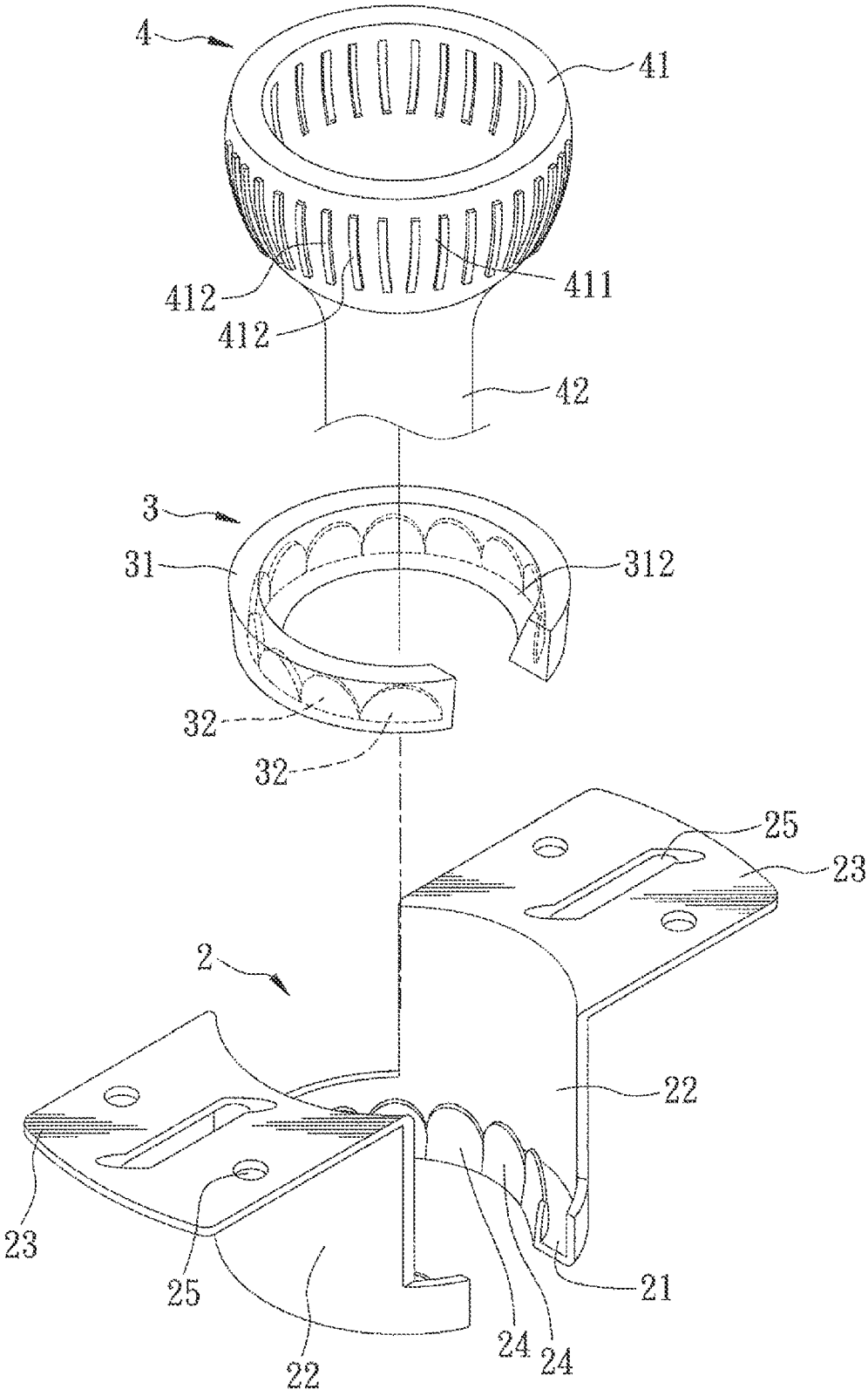
FIG. 2 is an exploded perspective view of a hanging frame assembly for a ceiling fan according to the first preferred embodiment of the present invention.
Figure 3:
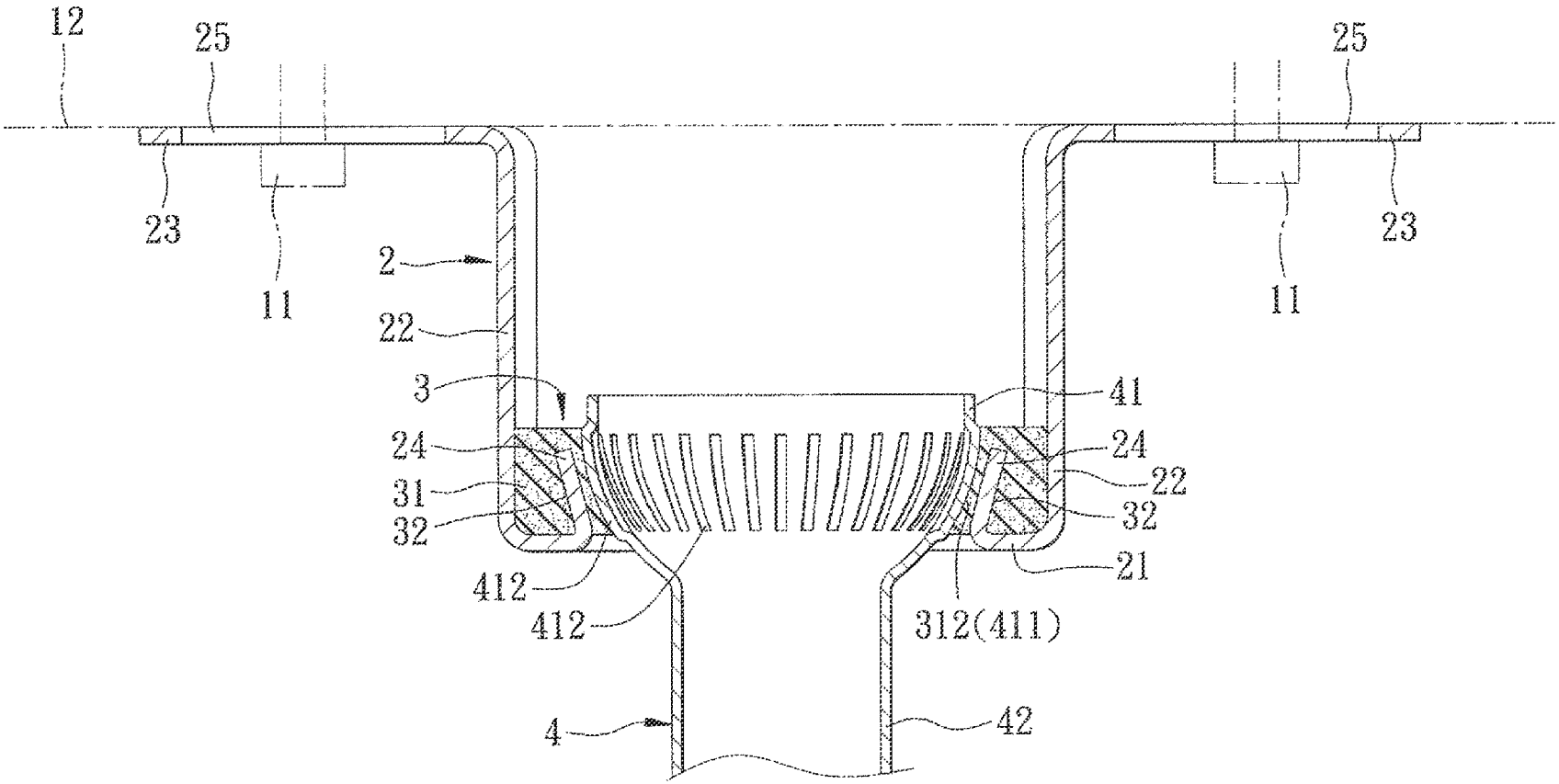
FIG. 3 is a sectional view of the first preferred embodiment in an assembled state.

Referring to FIGS. 2 and 3, a hanging frame assembly according to the first preferred embodiment of the present invention is shown to comprise a support seat 2, a buffer piece 3, and a hanging rod 4.

The support seat 2 is made of metal, and includes a bottom wall 21 forming a substantially C-shaped ring, two angularly spaced-apart sidewalls 22 extending upwardly from an outer peripheral end of the bottom wall 21, two wing plates 23 bending outwardly and respectively from top ends of the sidewalls 22, and a plurality of angularly spaced-apart positioning ribs 24 extending upwardly from an inner peripheral end of the bottom wall 21. In this embodiment, the support seat 2 includes ten positioning ribs 24, and each positioning rib 24 has a curved top end. Each wing plate 23 is provided with three spaced-apart through holes 25. A plurality of fixing elements, in the form of bolts 11, extend respectively through the through holes 25 in the wing plates 23, and engage a ceiling 12 to thereby fix the wing plates 23 to the ceiling 12.

The buffer piece 3 is made of rubber, and is mounted on the bottom wall 21 of the support seat 2. The buffer piece 3 has a buffer body 31 forming a substantially C-shaped ring and provided with a plurality of angularly spaced-apart positioning grooves 32 in a bottom surface thereof for receiving fittingly and respectively the positioning ribs 24. In this embodiment, the number of the positioning grooves 32 corresponds to the number of the positioning ribs 24 which is ten. Each positioning groove 32 has a shape similar to that of the positioning rib 24.

The hanging rod 4 includes a top head portion 41 and a tubular neck portion 42. The top head portion 41 is supported on the buffer body 31, and has a bowl-shaped surface 411 to engage an inner peripheral surface 312 of the buffer body 31, and a plurality of angularly spaced-apart strips 412 projecting outwardly and radially from the bowl-shaped surface 411 and extending substantially in a top-to-bottom direction. The tubular neck portion 42 extends downwardly from the top head portion 41 through the support seat 2, and has a bottom end (not shown) adapted to connect to a ceiling fan (not shown). The strips 412 abut fittingly against the inner peripheral surface 312 of the buffer body 31. The ratio of the number of the strips 412 to the number of the positioning ribs 24 may be 1:1, 2:1, 3:1, etc. In this embodiment, the ratio of the number of the strips 412 to the number of the positioning ribs 24 is 3:1.

Since the buffer piece 3 is made of rubber which has a vibration-absorbing effect, connection between the inner peripheral surface 312 of the buffer body 31 and the bowl-shaped surface 411 of the top head portion 41 can be enhanced. Further, the vibration and noise produced when the ceiling fan rotates can be suppressed to a minimum. Moreover, since the positioning ribs 24 are inserted fittingly into the respective positioning grooves 32, and since some portions of the inner peripheral surface 312 that correspond in position to the spaces between each two adjacent ones of the positioning ribs 24 are soft, when some of the strips 412 abut respectively against the soft portions of the inner peripheral surface 312, the soft portions of the inner peripheral surface 312 deform inwardly to form indentations. This results in a more stable connection between the hanging rod 4 and the buffer piece 3, and the provision of more rotational stability.

Figure 4:
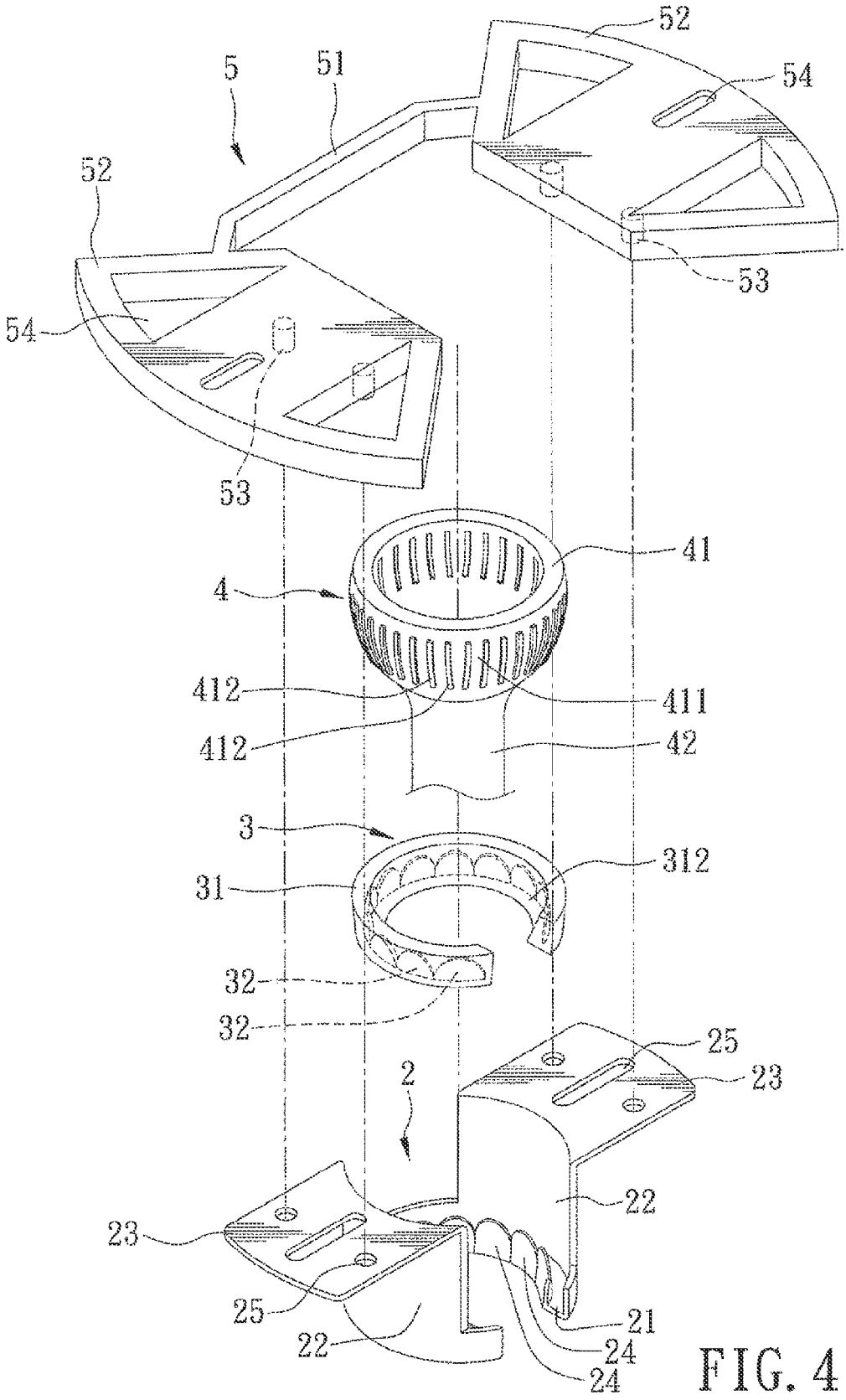
FIG. 4 is an exploded perspective view of a hanging frame assembly according to the second preferred embodiment of the present invention.
Figure 5:
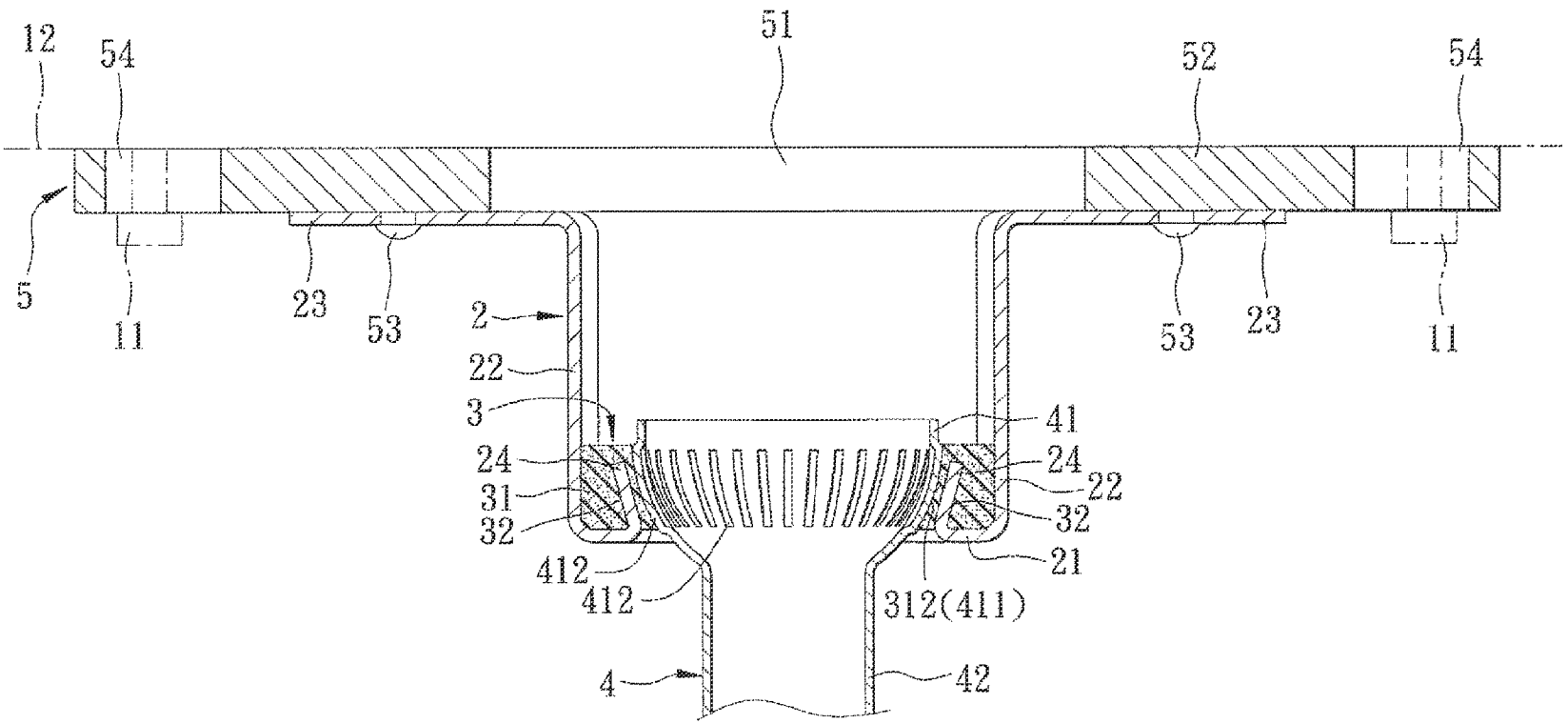
FIG. 5 is a sectional view of the second preferred embodiment in an assembled state.

Referring to FIGS. 4 and 5, a hanging frame assembly according to the second preferred embodiment of the present invention is shown to be similar to the first preferred embodiment. However, in this embodiment, the hanging frame assembly further comprises an auxiliary element 5. The auxiliary element 5 includes a connecting portion 51 disposed above the wing plates 23, and two extension portions 52 connected respectively to two opposite ends of the connecting portion 51. Each extension portion 52 has two spaced-apart protrusions 53 projecting downwardly therefrom, and three spaced-apart extension holes 54. The protrusions 53 of each extension portion 52 engage two of the through holes 25 in the respective wing plate 23 so as to fix the wing plate 23 on the respective extension portion 52. A plurality of fixing elements, in the form of bolts 11, extend respectively through the extension holes 54 so as to fix the extension portions 52 on the ceiling 12. In an alternative embodiment, the auxiliary element 5 may have a different shape with different dimensions so as to extend amounting area of the hanging frame assembly of the present invention, so that the hanging frame assembly of the present invention may be suitable for use to support different sizes of ceiling fans to different types of ceilings 12.

The advantages of the present invention may be summarized as follows:

1. Since the support seat 2 is made of metal, structural stability of the same can be enhanced, so that rotational stability of the ceiling fan may also be enhanced. Further, the buffer piece 3, which is made of rubber, can dampen impact caused by vibrations, thereby minimizing the noise produced by such impact.

2. The strips 412 of the hanging rod 4 can engage fittingly the inner peripheral surface 312 of the buffer piece 3 because of the deformability of the inner peripheral surface 312, so that rotation of the ceiling fan can be more stable, and vibrations can be simultaneously minimized.

3. The auxiliary element 5 may be configured having different dimensions and shapes so as to allow the hanging frame assembly of the present invention to be used for various different ceiling fans and on various different mounting sites.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A hanging frame assembly for a ceiling fan, comprising:

a support seat made of metal and including a bottom wall forming a substantially C-shaped ring, two angularly spaced-apart sidewalls extending upwardly from an outer peripheral end of said bottom wall, two wing plates bending outwardly and respectively from top ends of said sidewalls, and a plurality of angularly spaced-apart positioning ribs extending upwardly from an inner peripheral end of said bottom wall;

a buffer piece mounted on said bottom wall and made of rubber, said buffer piece forming a substantially C-shaped ring and having a plurality of angularly spaced-apart positioning grooves in a bottom surface thereof to receive fittingly and respectively said positioning ribs; and a hanging rod that includes a top head portion supported on said buffer piece, and a tubular neck portion extending downwardly from said top head portion through said support seat and adapted to connect to a ceiling fan, said top head portion having a bowl-shaped surface, and a plurality of angularly spaced-apart strips that project outwardly and radially from said bowl-shaped surface to engage an inner peripheral surface of said buffer piece and that extend substantially in a top-to-bottom direction.

2. The hanging frame assembly of claim 1, wherein each of said wing plates is provided with a plurality of through holes, and a plurality of fixing elements extending respectively through said through holes and adapted to engage a ceiling.

3. The hanging frame assembly of claim 1, wherein each of said wing plates is provided with a plurality of through holes, said hanging frame assembly further comprising an auxiliary element that includes a connecting portion, and two extension portions connected respectively to two opposite ends of said connecting portion, each of said extension portions having a plurality of spaced-apart protrusions, a plurality of spaced-apart extension holes, and a plurality of fixing elements, said protrusions of said extension portions engaging respectively said through holes in said wing plates to fix said wing plates to said extension portions, respectively, said fixing elements of said extension portions extending respectively through said extension holes and being adapted to engage a ceiling.

* * * * *